US008544642B1

(12) United States Patent
Lytle et al.

(10) Patent No.: US 8,544,642 B1
(45) Date of Patent: Oct. 1, 2013

(54) MULTIPURPOSE GOLF CLUB CONTAINER AND METHOD OF USE

(75) Inventors: Frank Lytle, West Chester, PA (US); James B Eldon, III, Barto, PA (US); David D McClanahan, Harleysville, PA (US)

(73) Assignee: Frank Lytle, West Chester, PA (US)

( * ) Notice: Subject to any disclaimer, the term of this patent is extended or adjusted under 35 U.S.C. 154(b) by 355 days.

(21) Appl. No.: 12/807,670

(22) Filed: Sep. 10, 2010

(51) Int. Cl.
*A45B 3/00* (2006.01)

(52) U.S. Cl.
USPC ..... 206/315.4; 206/315.1; 206/315.2; 206/315.3; 206/315.6; 150/159

(58) Field of Classification Search
USPC ..... 206/315.4, 315.6, 315.3, 315.11, 206/315.1; 150/159; 280/37, 47.26, 47.19; 296/83, 77.1, 37.16, 100.14
See application file for complete search history.

(56) References Cited

U.S. PATENT DOCUMENTS

| | | | | | |
|---|---|---|---|---|---|
| 1,570,500 | A | * | 1/1926 | Kennedy | 206/315.6 |
| 1,617,115 | A | * | 2/1927 | Hotze | 206/315.4 |
| 1,636,194 | A | * | 7/1927 | Mullins | 224/579 |
| 1,637,538 | A | * | 8/1927 | Sampson | 206/315.2 |
| 2,837,346 | A | * | 6/1958 | Chambless | 280/37 |
| 2,883,207 | A | * | 4/1959 | Reich | 280/47.19 |
| 2,890,061 | A | | 6/1959 | Watson | |
| 2,985,212 | A | * | 5/1961 | Dozier | 150/159 |
| 4,245,684 | A | | 1/1981 | Street et al. | |
| 4,319,616 | A | | 3/1982 | Light | |
| 4,657,135 | A | * | 4/1987 | Kjose | 206/315.3 |
| 4,915,221 | A | | 4/1990 | Spangler | |
| 5,024,259 | A | * | 6/1991 | Treadway | 150/159 |
| 5,146,967 | A | * | 9/1992 | Chapman | 150/159 |
| 5,168,992 | A | | 12/1992 | Bowdy | |
| 5,333,731 | A | * | 8/1994 | McCuaig | 206/315.6 |
| 5,415,284 | A | * | 5/1995 | King | 206/315.6 |
| 5,582,290 | A | * | 12/1996 | McCuaig et al. | 206/315.6 |
| 5,690,155 | A | * | 11/1997 | Millar | 150/159 |
| 5,704,475 | A | * | 1/1998 | Jack | 206/315.4 |
| 5,823,336 | A | | 10/1998 | Smith | |
| 6,007,134 | A | * | 12/1999 | Weston | 296/83 |
| 6,145,660 | A | | 11/2000 | Chou | |
| 6,155,418 | A | | 12/2000 | Chang | |
| 6,161,698 | A | * | 12/2000 | Bradshaw et al. | 206/527 |

(Continued)

FOREIGN PATENT DOCUMENTS

| | | | |
|---|---|---|---|
| GB | 2258405 | A | 10/1993 |
| GB | 2396304 | A | 6/2004 |

(Continued)

*Primary Examiner* — Anthony Stashick
*Assistant Examiner* — Cynthia Collado
(74) *Attorney, Agent, or Firm* — Alex R. Hobson; Invention To Patent Services LLC

(57) ABSTRACT

Provided is a multipurpose golf club container that can be used as a golf club travel container, a carrying container, pull along cart, or can be easily mounted onto a powered golf cart. The multipurpose golf club container is comprised of multiple compartments that can be closed to provide a rain proof enclosure. The multipurpose golf club container in some embodiments has a rain cover that can be easily deployed to keep the golf club grips dry during play in foul weather. In addition, in some embodiments the multipurpose golf club container is designed to retain the golf clubs in the head down position, and club restraints allow for quick and easy removal and replacement of the golf clubs from the container in a lateral motion.

19 Claims, 13 Drawing Sheets

(56) References Cited

U.S. PATENT DOCUMENTS

| | | | | |
|---|---|---|---|---|
| 6,217,042 | B1 * | 4/2001 | Kurtz et al. | 280/37 |
| 6,315,115 | B1 * | 11/2001 | Bradshaw et al. | 206/315.4 |
| 6,352,154 | B1 | 3/2002 | Miura | |
| 6,439,585 | B1 * | 8/2002 | Tan | 280/47.26 |
| 6,494,352 | B1 * | 12/2002 | Mullen | 224/524 |
| 6,659,477 | B2 * | 12/2003 | Jung | 280/47.26 |
| 7,337,898 | B2 | 3/2008 | Lewter | |
| 7,448,666 | B2 * | 11/2008 | Tyrer | 296/100.14 |
| 7,585,010 | B2 * | 9/2009 | Hardy et al. | 296/37.16 |
| 7,735,643 | B2 * | 6/2010 | Sanches et al. | 206/315.3 |
| 2002/0162761 | A1 | 11/2002 | Morgenstern | |
| 2003/0102643 | A1 * | 6/2003 | Jung | 280/47.26 |
| 2003/0106817 | A1 | 6/2003 | Buckley | |
| 2006/0207899 | A1 | 9/2006 | Handa et al. | |
| 2008/0245689 | A1 | 10/2008 | He | |
| 2009/0008204 | A1 | 1/2009 | Yen | |

FOREIGN PATENT DOCUMENTS

| | | | |
|---|---|---|---|
| WO | WO94/11065 | A1 | 5/1994 |
| WO | WO2007/109831 | A1 | 10/2007 |
| WO | WO2009/012769 | A1 | 1/2009 |

* cited by examiner

MULTIPURPOSE GOLF CLUB CONTAINER AND METHOD OF USE

FIELD OF THE INVENTION

The invention relates to multipurpose golf club containers and method of using.

BACKGROUND OF THE INVENTION

Conventional golf bags retain golf clubs in the head up orientation; with the handles down in the bag and the club heads loosely sticking out of the top of the bag. This configuration has many drawbacks. One drawback is the awkward motion required to remove a club from the bag. Clubs have to be completely lifted up and out of the bag. Another drawback is that the golf club heads can easily bump and bang into each other and become damaged during transport or during play. Club head covers are used to reduce this type of damage. Unfortunately, club head covers have to be removed and replaced each time a club is used; which is time consuming and tedious. In addition, the removal and replacement of the clubs into the bag can cause abrasion and wear to the grips. Furthermore, most conventional golf bags have a number of dividers allowing a player to place clubs in different areas of the top opening. Usually two or more clubs are placed in a particular divided area which can make it difficult to quickly locate a particular club and does not allow for quick recognition of missing clubs.

Another disadvantage of conventional golf bags is their poor protection from rain. In the event of rain, the golf club grips typically become wet as the water runs down the shafts of the clubs. It becomes very difficult to play golf when the club grips become wet. Some bags are made with covers than can be placed over the clubs; however, the cover has to be moved out of the way to retrieve a club which exposes the clubs to the rain.

Some golfers choose to carry their clubs, while others prefer to use a pull along cart, while still others prefer to ride in a powered golf cart. Many golfers like to vary how they transport their clubs around the course, carrying the clubs on one day, and then using a golf cart on other days or on longer courses. Furthermore, some golfers like to take their golf clubs with them when they travel. Therefore, a golfer may require a lot of equipment including a golf bag, a pull cart, and a travel case. Purchasing, storing and keeping track of all of this equipment is expensive and troublesome.

There exists a need for a golf club container that can be used for multiple purposes including a traveling case, a pull along golf cart, a carrying container, or powered golf cart carrier. In addition, there exits a need for a golf club container that can prevent the golf club grips from getting wet during play. Furthermore, there exists a need for a golf club container that provides for lateral removal and replacement of the golf clubs and quick identification of particular clubs within the container.

SUMMARY OF THE INVENTION

A multipurpose golf club container that can be used as a traveling case, a pull along golf cart, a carrying container, or powered golf cart carrier is provided. The multipurpose golf club container is generally defined by two compartments that can be brought together and latched to form a completely enclosed volume for retaining golf clubs. The multipurpose golf club container in some embodiments is designed for retaining golf clubs in the head down position and the open configuration of the compartments allows for easy lateral removal and replacement of a golf club as well as quick identification the clubs. In some embodiments the multipurpose golf club container is equipped with a rain cover that provides for access to the clubs while deployed. The interior of the compartments comprise club restraints for securing the clubs during transport. In some embodiments the restraints are hinged such that the clubs can be easily removed and replaced from the restraints.

The methods of using a multipurpose golf club container is provided, including traveling case, pull along cart, carrying container or powered golf cart container. When the multipurpose golf club container is used as a pull along cart, a retractable handle provides for easy maneuvering of the device. When the multipurpose golf club container is used as a travelling bag, the compartments are closed and in one embodiment a lock provides the traveler with a means to prevent unwanted entry into the container. When the multipurpose golf club container is used as a golf container and retained on a powered golf cart, strap fasteners allow, and base mounts provide, for securing the container to the cart.

BRIEF DESCRIPTION OF THE FIGURES

These and other advantages of the present invention are best understood with reference to the drawings, in which.

Each item number used to indicate a particular feature or element in the figures is used consistently throughout all figures, however, not all features in each figure are referred to in the description.

DETAILED DESCRIPTION OF THE INVENTION

As used herein, the terms "comprises," "comprising," "includes," "including," "has," "having" or any other variation thereof, are intended to cover a non-exclusive inclusion.

For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Figure 1:
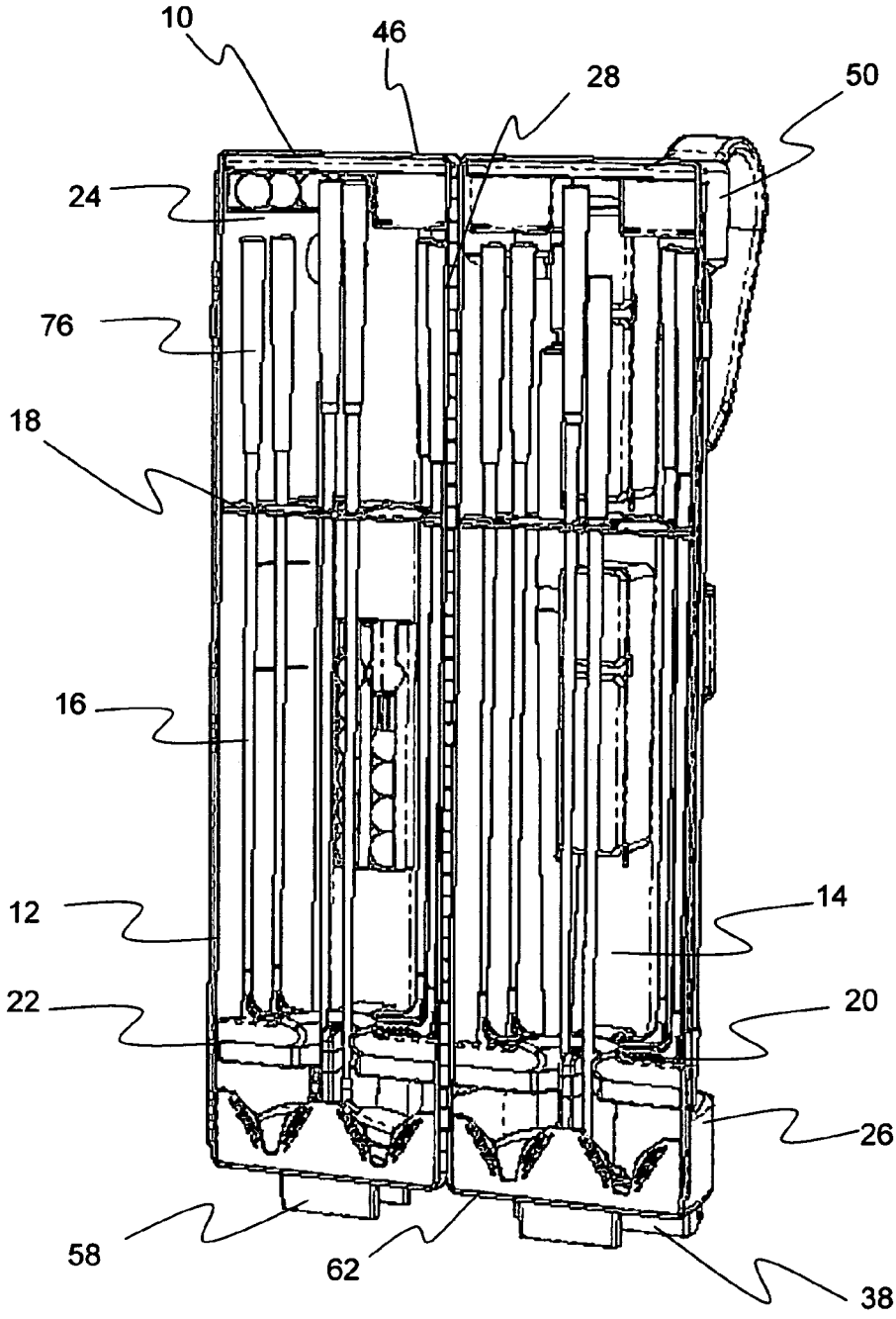
FIG. 1 is an isometric view of one embodiment of the multipurpose golf club container.

The multipurpose golf club container of the present invention can be used for a variety of purposes including but not limited to a traveling case, a pull along golf cart, or a golf club container that can be carried or retained on a powered golf cart. The multipurpose golf club container 10 is generally defined by multiple compartments that can be closed for form an enclosure around an interior volume. In one embodiment the multipurpose golf club container is comprised of a first compartment 12 and a second compartment 14 for retaining golf clubs 16 as depicted in FIG. 1. The golf clubs 16 in some embodiments are retained in the multipurpose golf club container 10 by shaft restraints 18 as depicted in FIG. 1. In some embodiments the golf clubs 16 are positioned in the head down position, as depicted in FIG. 1, where the club head 20 is retained by a club head retainer 22. The multipurpose golf club container 10 depicted in FIG. 1 has an interior surface 24 and exterior surface 26, top 46 and bottom portions 62, and wheels 38. Multiple compartments may be used to form the golf club container, and one or more of the compartments may be designed for containing golf clubs. In one embodiment the multipurpose golf club container is a clamshell design having two compartments that can be closed to define an interior volume as depicted in FIG. 1. Furthermore, in the clamshell design depicted in FIG. 1, golf clubs are contained within each of the two compartments, in that the entire golf club is within the compartment. In one embodiment, the compartments are rigid and therefore provide more protection for the contents stored therein.

Figure 2:
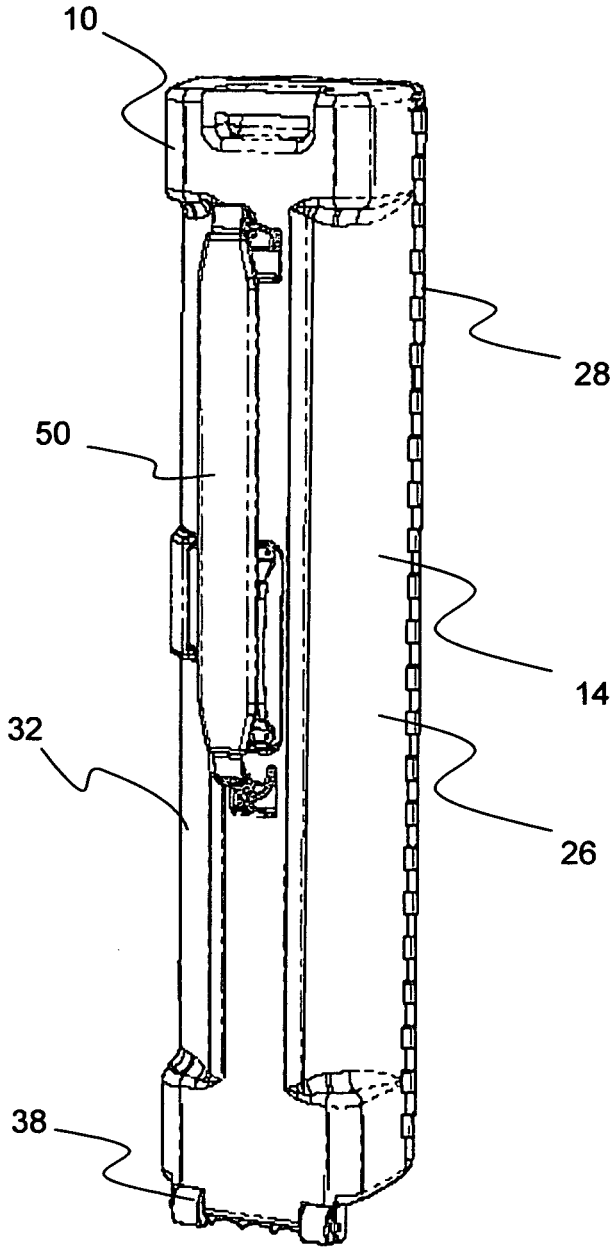
FIG. 2 is an isometric view of a multipurpose golf club container in a closed orientation.
Figure 3:
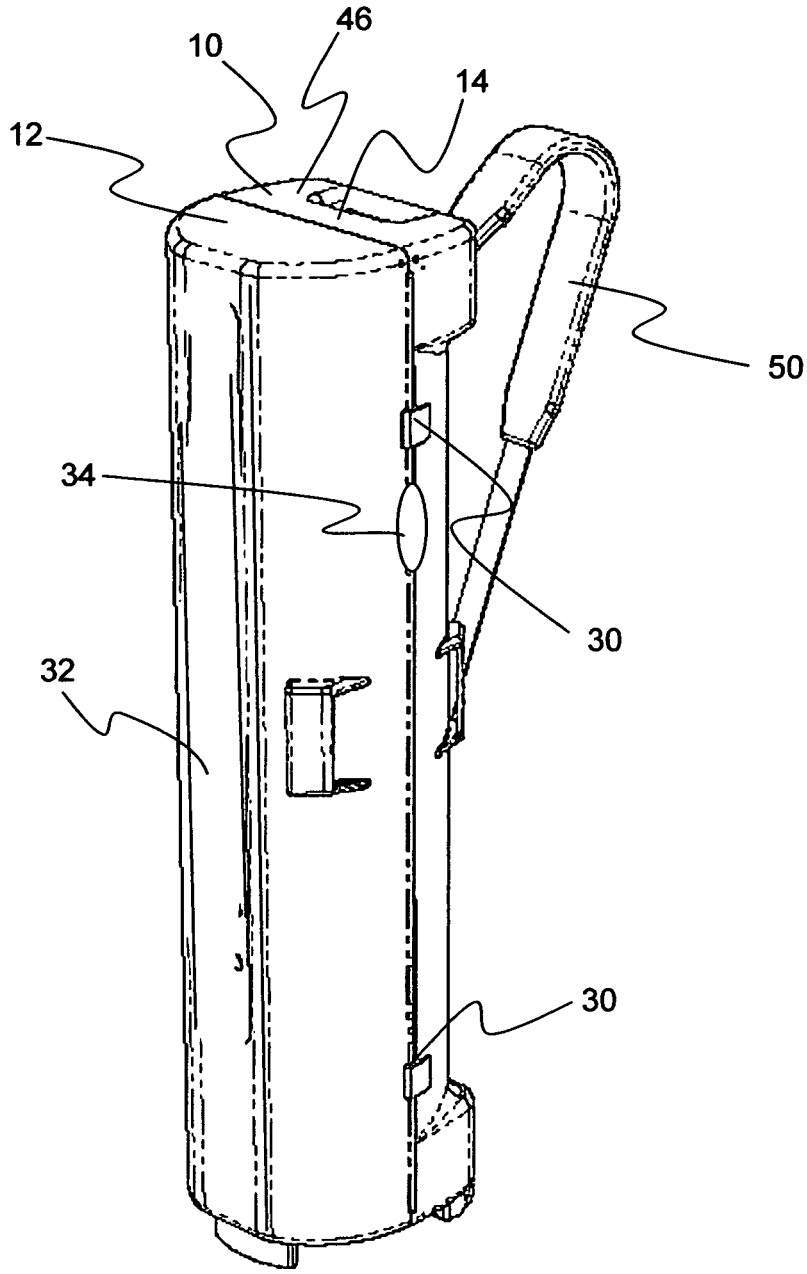
FIG. 3 is an isometric view of a multipurpose golf club container in a closed orientation.

The compartments of the multipurpose golf club container are connected by a hinge 28 that allows for the compartments to be brought together and latched to form a completely enclosed volume for retaining golf clubs as depicted in FIG. 2 and FIG. 3. The hinge as used herein is defined as any conventional hinge that provides a means to open and close compartments. In the closed configuration as depicted in FIG. 3, the multipurpose golf club container 10 can be used as a traveling case 32, and in some embodiments the latch 30 may have a locking mechanism, or a separate lock 34 or a means to lock the container may be provided to further secure the contents therein.

Figure 4:
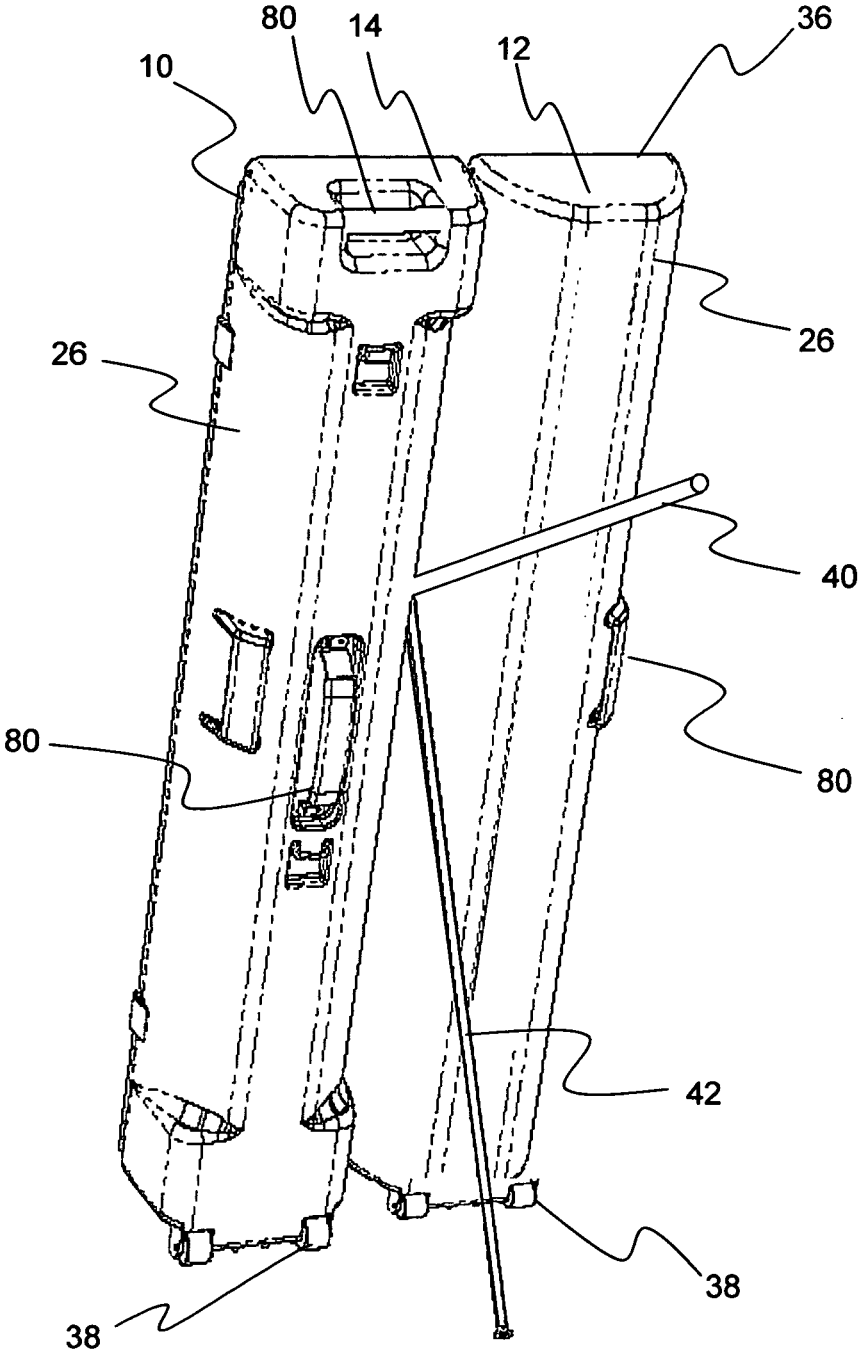
FIG. 4 is an isometric view of a multipurpose golf club container wherein it is a pull along cart.

The multipurpose golf club container 10 can also be used as a pull along cart 36 as depicted in FIG. 4, where the container has wheels 38, a handle 40 and in some embodiments a stand 42. The handle allows the golfer to easily maneuver the container by pushing or pulling the container and may be a retractable, detachable or extending handle or the like. In one embodiment the strap or a portion of the strap may be used as a handle. When using the container as a pull along cart, the compartments can be in the open position during play, providing for easy lateral removal and replacement of the golf clubs. In some embodiments, the multipurpose golf club container may be further designed to have a stand, and preferably a retractable stand, that may be designed to open automatically. It is envisioned that a retractable stand mechanism may operate and be designed like those of conventional golf bags. The retractable stand may open automatically as the top of the container is angled downward as depicted in FIG. 4. The stand may be comprised of one or more support members.

Figure 5:
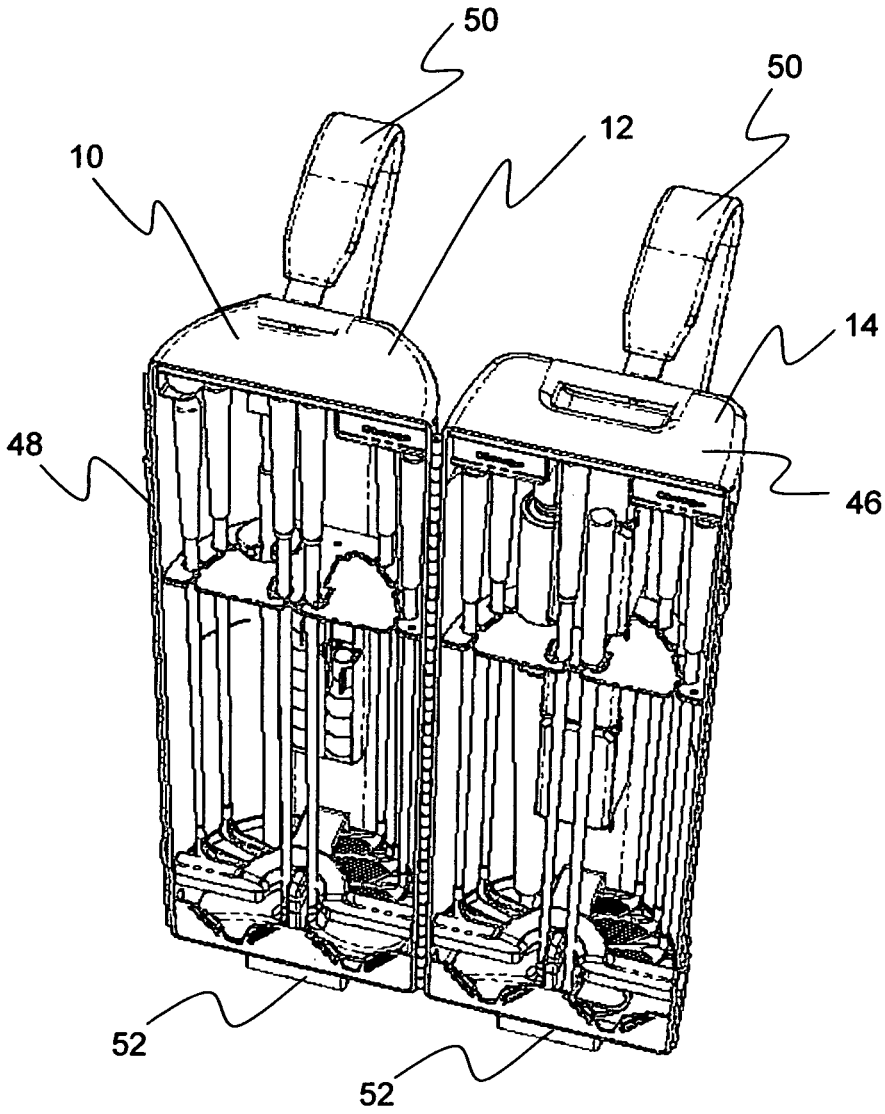
FIG. 5 is an isometric view of a multipurpose golf club container wherein it is a carrying container.

In another embodiment, the multipurpose golf club container is used as a carrying container 48, as depicted in FIG. 5 wherein the container has a strap or straps 50. In one embodiment the strap or straps 50 are designed to go around both shoulders and the multipurpose golf club container can be carried in the open position as depicted in FIG. 5. In yet another embodiment the carrying container is designed to have a retractable stand that automatically opens to secure the container when the container is placed on the ground and tilted down, as depicted in FIG. 4. In one embodiment, the wheels may be designed to fold up or retract so that the multipurpose golf club container, when being used as a carrying container, does not roll or pivot. In yet another embodiment, the base mounts 52 as depicted in FIG. 5 are designed such that they are adjustable to provide more support of the multipurpose golf club container when being used as a carrying container. For example, the base mounts may be rotated, extended, expanded, or slid to provide a more stable base for support. Furthermore, the base mounts may be designed to prevent the wheels from touching the ground, therein providing more support. Furthermore, the multipurpose golf club container, in some embodiments, is designed with handles 80 as depicted in FIG. 4 to facilitate carrying during play or transport.

Figure 6A:
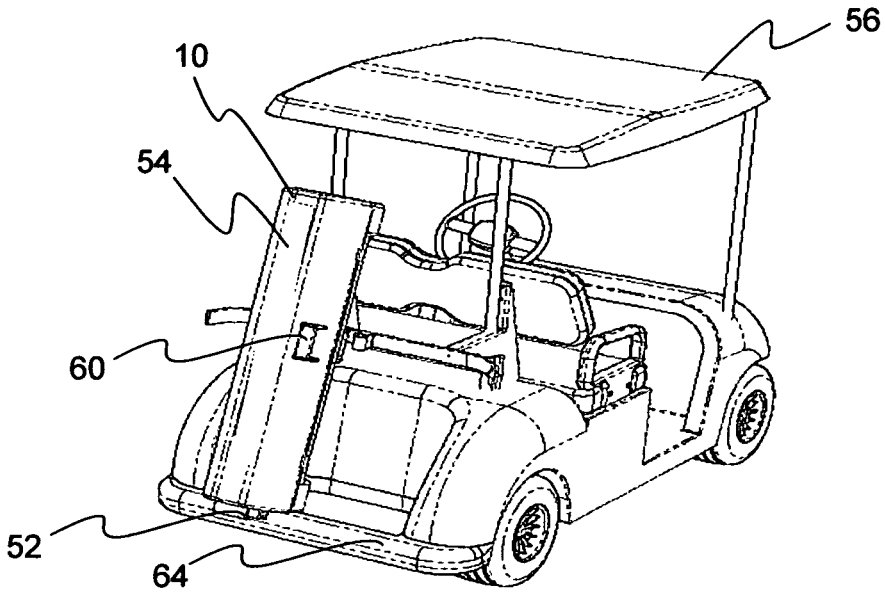
FIG. 6A is an isometric view of a multipurpose golf club container located on a powered golf cart in the closed orientation.
Figure 6B:
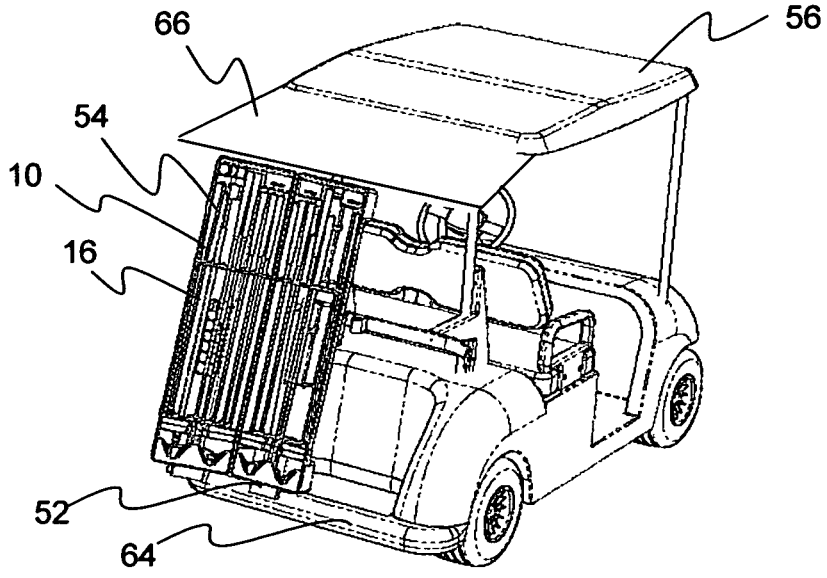
FIG. 6B is an isometric view of a multipurpose golf club container located on a powered golf cart in the open orientation.
Figure 7:
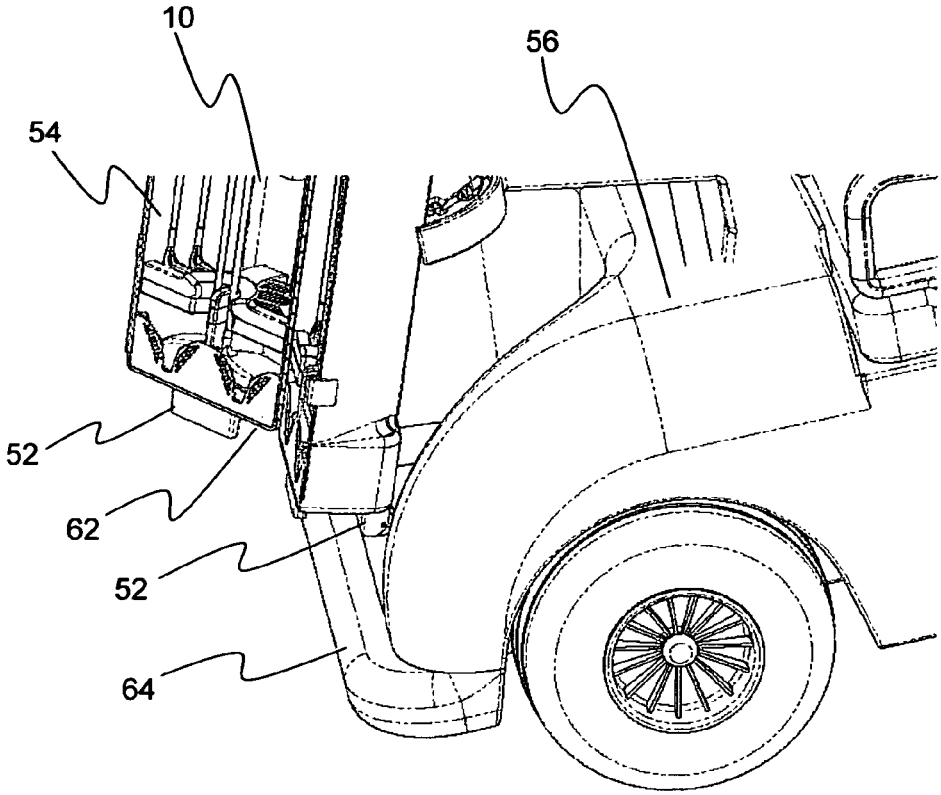
FIG. 7 is an isometric view of the bottom section of the multipurpose golf club container located on a powered golf cart.

The multipurpose golf club container 10 can also be used as a powered golf cart club container 54 as depicted in FIG. 6A and FIG. 6B, where the container is positioned on the golf cart 56 and restrained. The multipurpose golf club container 10 is positioned on the golf cart 56 in the open configuration, as depicted in FIG. 6B to allow for easy access of the golf clubs 16. Again, the clubs would be easily removed from and replaced in a lateral motion. In this embodiment, the powered golf cart club container 54 is designed with base mounts 52 and strap fasteners 60 for securing the multipurpose golf club container 10 to the golf cart 56, as depicted in FIG. 6A and FIG. 6B. In one embodiment the base mounts 52, as depicted in FIG. 7, are protrusion from the bottom 62 of the multipurpose golf club container 10 that fit around the bumper 64 of the golf cart 56, and in one embodiment may be adjustable to provide for different cart bumper geometries. The strap fasteners 60 may be features such as slots, clamps or the like for securing the powered golf cart straps. The strap fasteners and base mounts may also be used to secure the multipurpose golf club container to a pull along cart.

Many powered golf carts have rain covers or retractable rain covers 66 that extend off of the back of the cart and over the clubs as depicted in FIG. 6B. When using conventional golf bags, the golf clubs can not be easily removed without hitting the rain cover. In some cases, the retractable rain cover has to be pushed back out of the way to remove or replace a golf club from a conventional golf bag, exposing the clubs to the rain. With the multipurpose golf club container of the present invention, the golf cart protective rain cover would not impede the retrieval of golf clubs, and the clubs would be better protected from the foul weather. Golf clubs could be removed and replaced from the multipurpose golf club container with the rain cover engaged. The clubs could be pulled from the club restraints and pulled out from a compartment without disengaging the rain cover or exposing any of the other clubs to the rain.

Figure 8:
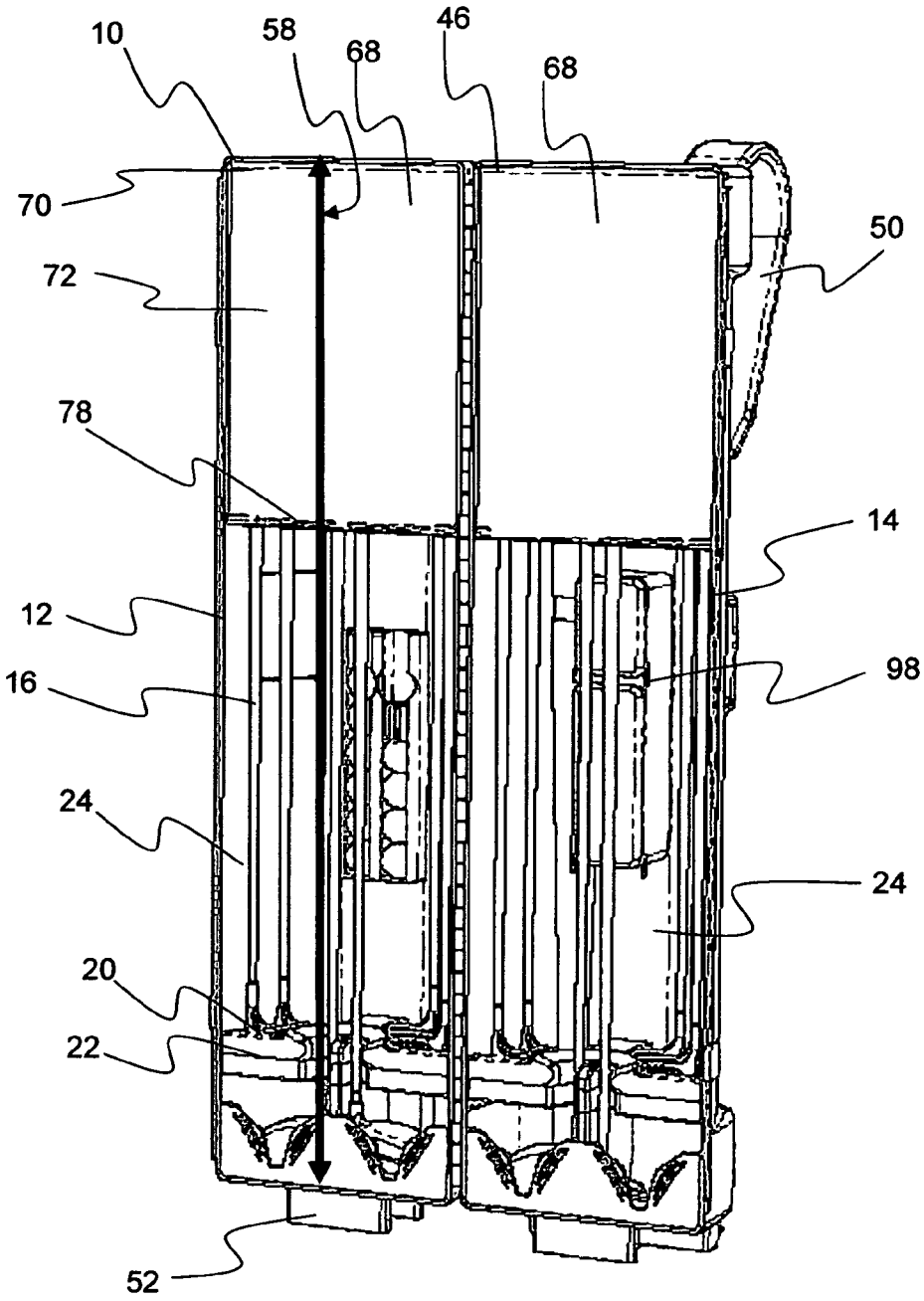
FIG. 8 is an isometric view of a multipurpose golf club container having a rain cover.

The multipurpose golf club container in some embodiments is configured to have a rain cover to protect the golf clubs when in the open position. A rain cover 68 as depicted in FIG. 8 is comprised of a rain barrier material 72 that extends down from the top 70 of the multipurpose golf club container 10. The rain barrier material can be any suitable material that prevents the passage of water and is preferably flexible, water shedding and hydrophobic. Suitable materials include but are not limited to plastics, nonwovens, fabrics, films or foils and the like. The rain cover may be attached to the multipurpose golf club container by any conventional means such as with clasps, hooks, clamps, and the like. A sheet or sheets of the barrier material may be attached to the multipurpose golf club container in the event of rain, and removed and stored in or on the multipurpose golf club container when not in use.

In one embodiment, separate integral rain covers 68 are fitted to the top of each compartment, as depicted in FIG. 8. An integral rain cover is attached to the multipurpose golf club container and simply requires the extension of the rain barrier to protect the interior contents. In one embodiment, the integral rain cover is permanently attached to the multipurpose golf club container. In one embodiment the rain cover may be a spool of material that can be pulled down to protect at least a portion of the interior contents of the multipurpose golf club container from getting wet. The rain barrier may be extended a portion of the length 58 down a compartment, or it may be extended to completely cover and protect the interior of the compartment.

Figure 9:
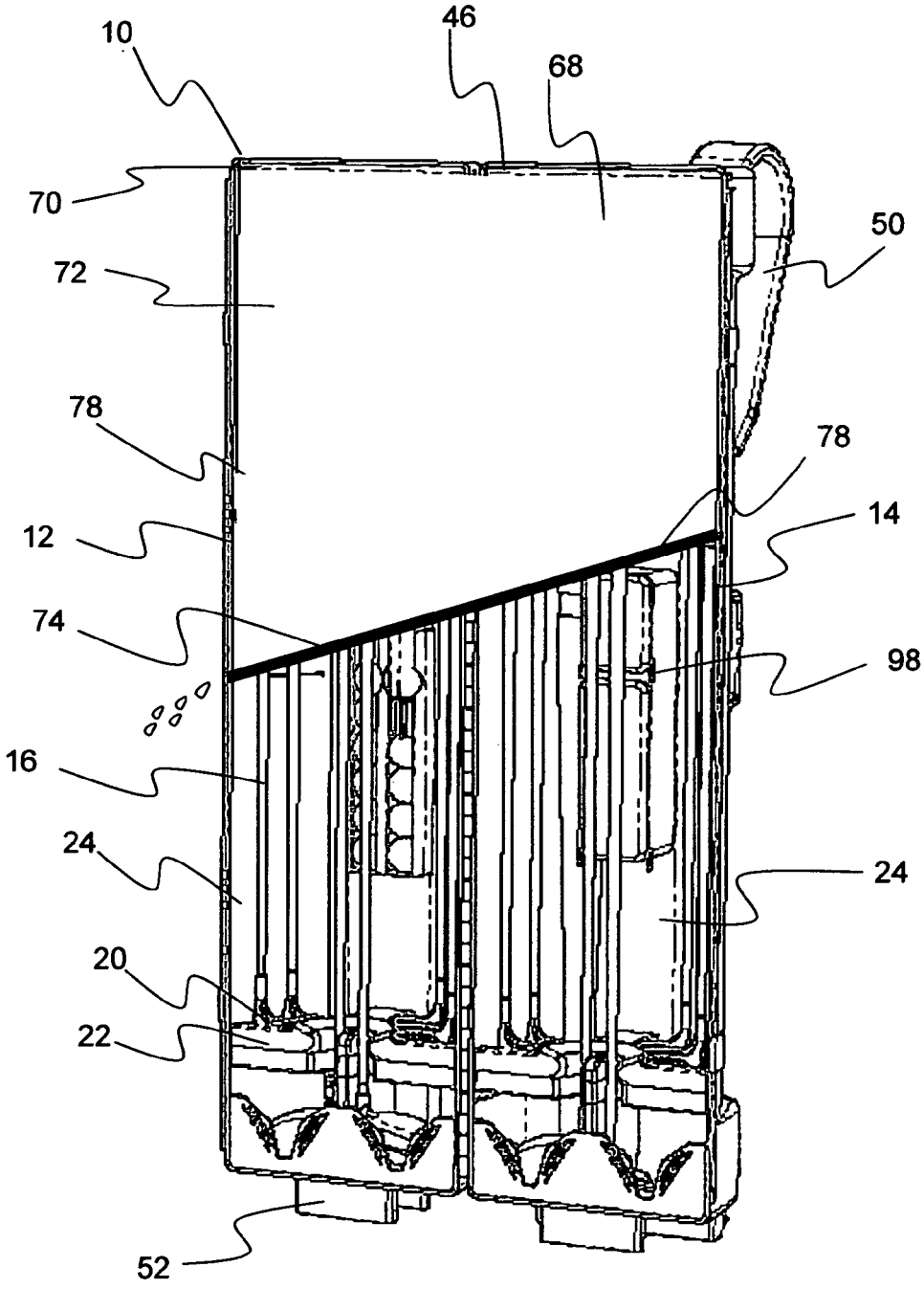
FIG. 9 is an isometric view of a multipurpose golf club container having a rain cover.

In another embodiment, as depicted in FIG. 9, the rain cover 68 extends from the first compartment 12 to the second compartment 14, covering at least a portion of the interior 24 of both compartments. In some embodiments the rain cover is designed with a retracting mechanism that retracts the rain cover barrier material much like a window shade that can be pulled down and retracted by pulling down quickly and releasing, or pushing up on the material, or the like. In one embodiment, the retracting mechanism is engaged or disengaged by pushing of a button, or sliding of a stop. The rain cover and multipurpose golf club container may further be designed to have a means for retaining the extended barrier material from moving or blowing out of position during bad weather. For example, clips or fasteners may be used and can be of any conventional type including but not limited to, hook and loop, snaps, buttons, interference fit feature, magnetic feature, and the like. In yet another embodiment, as depicted in FIG. 9, the rain cover is designed with a rain runoff feature 74 at the end 78 of the barrier material 72 to channel the water to the outside area of the container, and therein prevent or reduce dripping over the area where clubs 16 are to be retrieved. The rain runoff feature may be a u-shaped channel that catches the water at the end of the barrier material, allowing it to flow to the edges. The barrier material 72 may be designed to have an angle or angles along the end 78 to further facilitate the removal of water, as depicted in FIG. 9

In yet another embodiment, the rain cover material is transparent or translucent to allow the user to more easily identify and remove or replace items from the container. In one embodiment, the rain cover is configured to be mounted on the exterior wall of the multipurpose golf club container, therein preventing residual water remaining on the rain cover from wetting the interior of the container.

In embodiments where the multipurpose golf club container is designed for the club heads to be facing down, the grips of the clubs are better protected from getting wet when the rain cover is employed. Conventional golf bags are designed for the club grips to face down, and when rain occurs during play, the rain runs down the club shaft and the grips become wet and slippery which makes play very difficult. In contrast however, the configuration of the golf clubs in the head down position, and the rain cover of the present invention, allow for dry grips and continuous play during rain. In the event that the weather becomes worse, the multipurpose golf club container may be closed to ensure that the contents stay dry. The multipurpose golf club container is rain proof as defined herein when in the closed orientation. The rain cover could be employed when the multipurpose golf club container is used as a pull along golf cart, a carrying container, or powered golf cart club container.

Figure 10A:
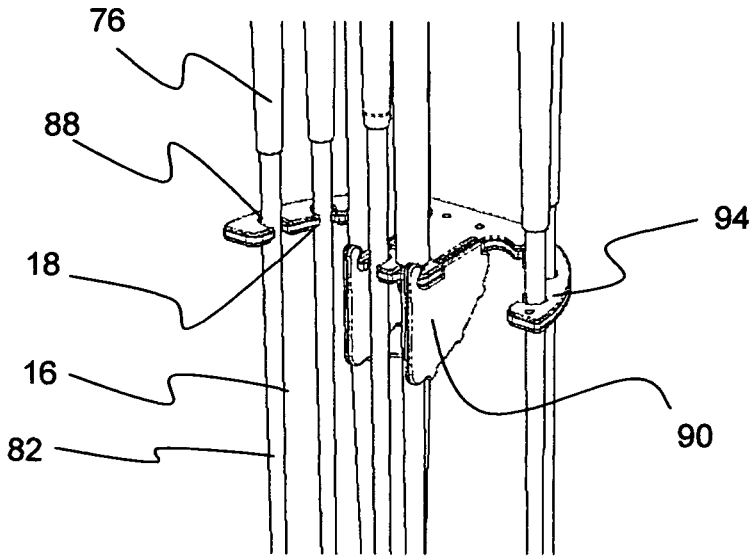
FIG. 10A is an isometric view of a shaft restraint manifold.
Figure 10B:
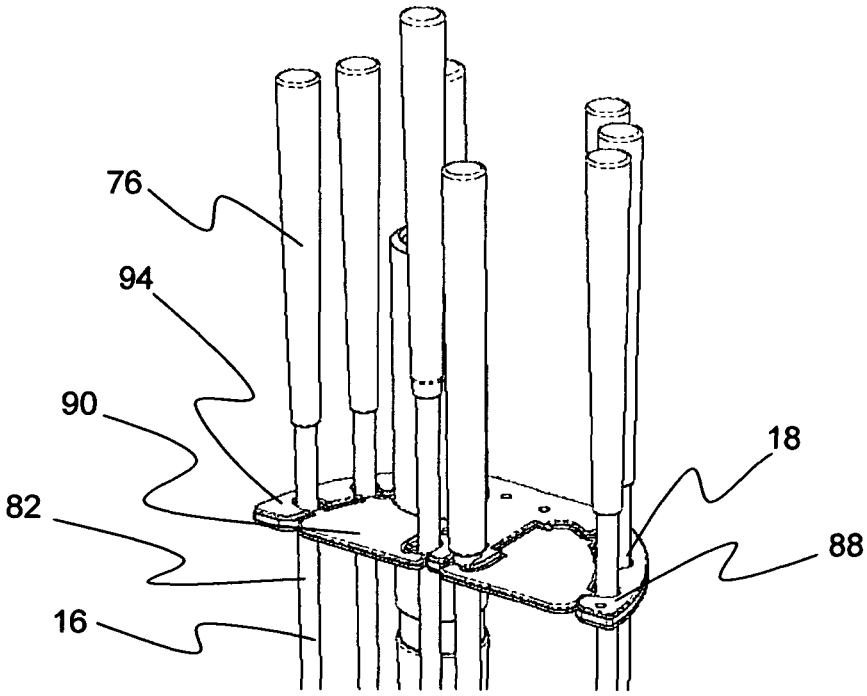
FIG. 10B is an isometric view of a shaft restraint manifold with locking feature engaged.

The shaft restraints of the present are designed to secure the shaft of the golf club but also allow for easy removal and replacement of the clubs, and may be individually mounted to the interior wall of the compartment, or they may be designed as a manifold; one or several pieces fitted within a compartment. In one embodiment, the manifold generally conforms to the interior wall of the compartment where the golf clubs are positioned next to each other. In other embodiments, at least some of the clubs may be restrained at some distance normal to the interior wall of the compartment as depicted in FIGS. 10A and 10B. This configuration allows for better packing of the golf clubs within the interior of the compartment. In yet another embodiment, a manifold comprises club restraints along the interior wall of the compartment and has a protrusion having shaft restraints some distance from the compartment wall. The restraints positioned away from the compartment wall may be for clubs that do not pack neatly, such as woods or putters.

In one embodiment as depicted in FIG. 10A and FIG. 10B, the shaft restraint 18 comprises a shaft restraint manifold 94 having recesses 88 that are designed to accept the club shaft 82 and a mechanism to hold the shaft in place. The mechanism may be a spring or elastomeric element that deflects when the shaft is inserted and likewise deflects when the shaft is removed. It is conceived that any number of latching or interference fit mechanisms could be employed to secure the club shaft in place. In one embodiment the recess is configured with an elastomeric material along edge of the recess that deforms when the shaft is inserted into the recess. In another embodiment, a closing feature is configured to reduce the opening size of the recess and is deflected out of position allowing for the insertion of the club. The closing feature may only partially close off the opening to the recess and may be configured with a spring or elastomeric material. In yet another embodiment the shaft restraint is configured to accept a grommet that can be used to change the size of the recess. For example, a grommet may be used to convert a recess to accept a smaller sized club shaft or golf accessory such as a ball retriever. The shaft restraints in one embodiment secure the golf club along the grip. However, in a preferred embodiment, the shaft restraint secures the golf club along the shaft.

In some embodiments, a restraint lock 90 may be used to ensure that clubs do not fall out of the shaft restraint 18 during, for example, travel, as depicted in FIG. 10B. The restraint lock may comprise a sliding or hinged member that partially or fully closes the opening of the shaft restraint. In one embodiment a hinged element is employed to secure the club shaft and a restraint lock engages the hinge in such a manner as to prevent it from opening; ensuring that the club shaft is restrained. In one embodiment, as depicted in FIG. 10A and FIG. 10B, a restraint lock 90 pivots out of position to allow for the removal of clubs 16, and can be pivoted into position to close off the recesses 88 and ensure the clubs are restrained.

Club identifiers may be located within each compartment, or more specifically, may be positioned near the restraints to allow for quick identification of clubs. The club identifiers may simply be a place where the club type can be labeled, or where a pre-printed sticker is placed, or the like. The club identifier may also be marked by press molding when a multipurpose golf club container is manufactured.

Figure 11:
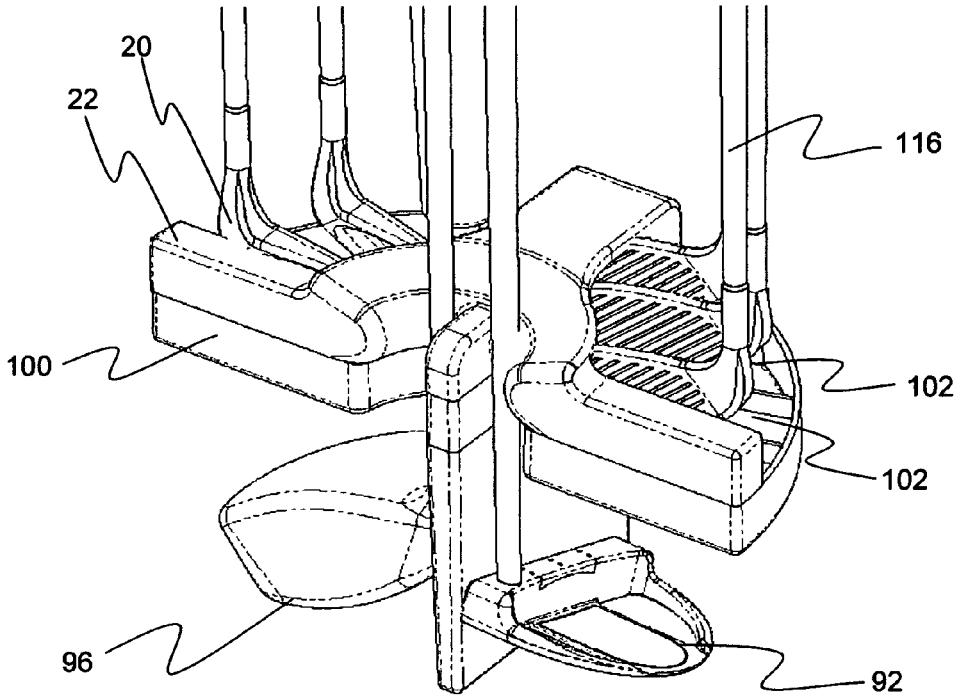
FIG. 11 is an isometric view of a club head retainer.
Figure 12:
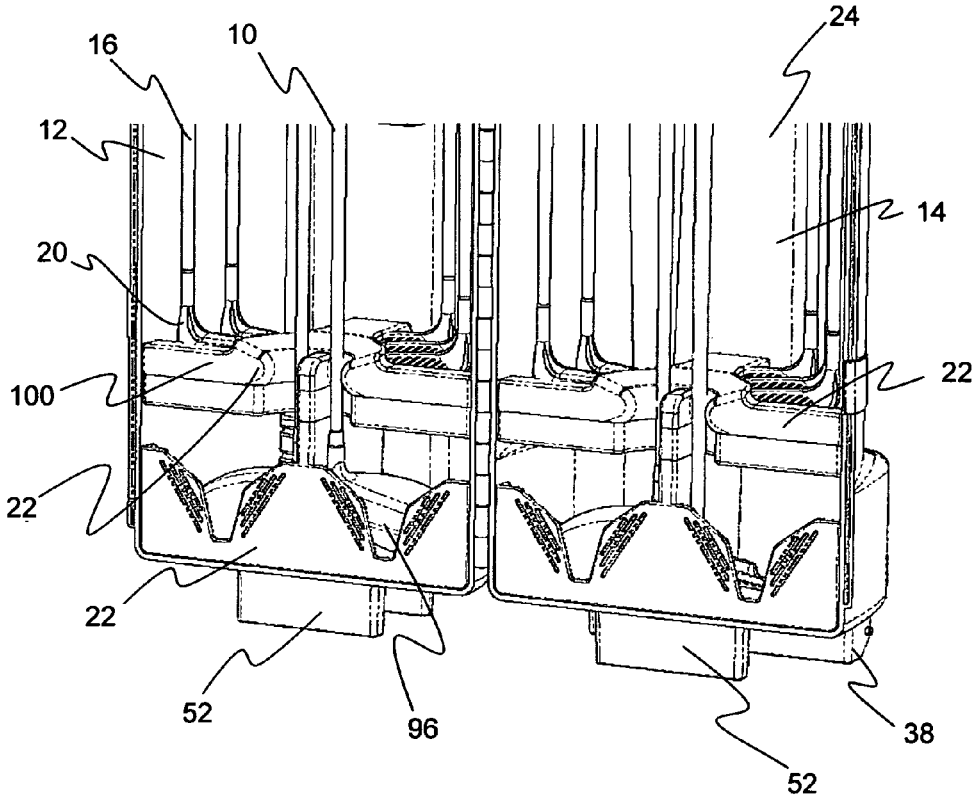
FIG. 12 is an isometric view of a club head retainer in the multipurpose golf club container.

In some embodiments, the golf clubs 16 are retained in the multipurpose golf club container in a head down position, and the club heads are retained in a club head retainer 22 as depicted in FIG. 11 and FIG. 12. A club head retainer may comprise recesses or slots 102, as depicted in FIG. 11 that are designed to geometrically fit the general shape of club heads 20, including irons 116, woods 96 and putters 92, for example. In one embodiment, as depicted in FIG. 12, the club head retainer 22 is a club head manifold 100, having multiple holding areas within one piece that is designed to fit within a compartment 12. In one embodiment, the club head retainer comprises a compressible material that deforms to the shape of the club head when it is pressed into position. The compressible material make take a permanent set to the club head geometry, or it may be a resilient material that at least partially recovers its original shape when the club is removed. Suitable compressible materials include but are not limited to foam, fabric, nonwovens, elastomers or gels. The club head retainer should be made to have a surface material that does not abrade the club head. The multipurpose golf club container may be designed with multiple club head restraints 22 to accommodate the longer and shorter clubs, as depicted in FIG. 12.

Figure 13:
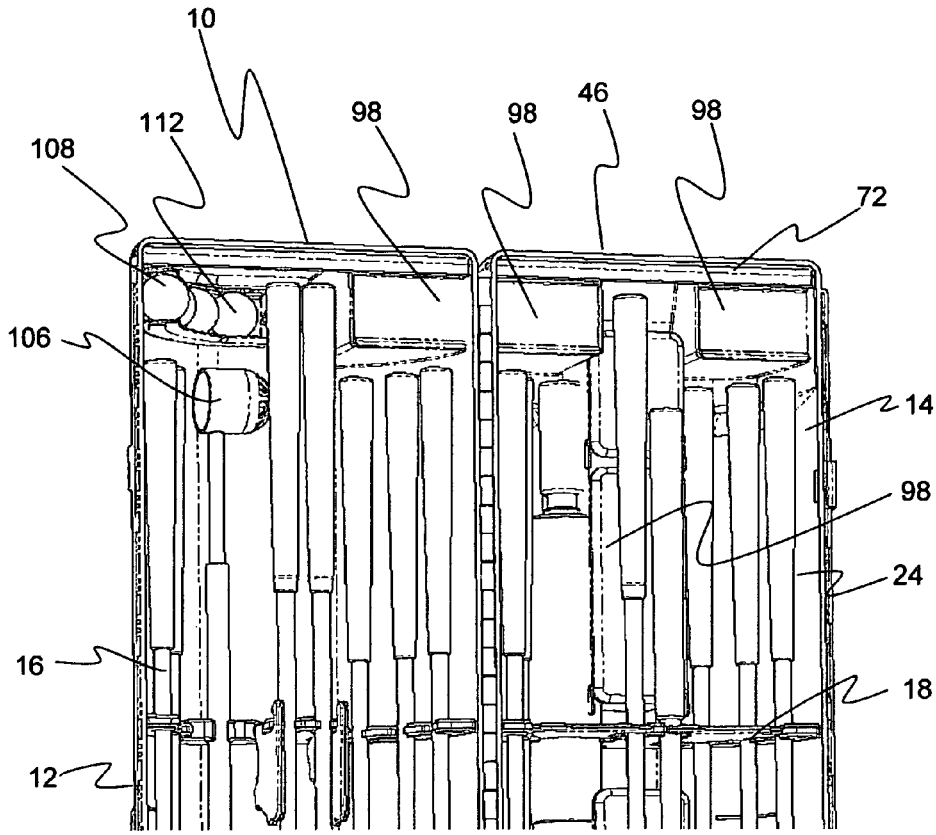
FIG. 13 is an isometric view of storage features within the multipurpose golf club container.

The multipurpose golf club container may be designed with a variety of different equipment and accessory storage and retaining features. As depicted in FIG. 13, storage features 98 may provide useful locations to store equipment, golf accessories, golf apparel, or personal items. In addition, geometric holding features 108 such as slots, holes or the like may be designed into the multipurpose golf club container to hold items such as golf balls 112 as depicted in FIG. 13. Storage or holding features may be on the interior and/or exterior of the multipurpose golf club container. The interior storage features provide for more secure storage when using the multipurpose golf club container as a transport case, as there would be no access to the interior storage features when the multipurpose golf club container is closed. In yet another embodiment, dual access storage features may be designed to have access from the interior and exterior of the multipurpose golf club container.

The multipurpose golf club container can be made of any suitable material such as but not limited to plastic, wood, metal, fabric, or any combination thereof. In a preferred embodiment, the shell of the multipurpose golf club container is made essentially of formed plastic providing a rigid container. In one embodiment the compartments of the multipurpose golf club container are rigid and made out of a single formed piece of material. In another embodiment, a compartment has a section that can be removed and in some cases stored in or on the multipurpose golf club container. For example, the top section of the compartment may be removed and snapped onto the exterior of the bottom section of the compartment.

DEFINITIONS

Multipurpose as used herein in reference to the multipurpose golf club container means that the said container can be used in at least two of the following ways: as a transport case, as a pull along golf cart, as a carrying golf club container or as a powered golf cart club container. In one embodiment, the multipurpose golf club container is designed to function in all of the aforesaid ways.

Compartment as used herein is defined as one of the parts into which an enclosed space is divided. The multipurpose golf club container of the present invention has at least two compartments that when in the closed position define an enclosed space and wherein each compartment comprises and interior volume.

Contained or containing as used herein in reference to golf club within a compartment means that the entire golf club is held within the interior volume of the compartment; the plane defining the opening of the compartment would have to be crossed in order to remove or replace a golf club.

Integral rain cover as used herein is defined as a rain cover that is part of the container and simply requires the extension of the rain barrier material to protect the interior contents.

Engaged position, as used in relation to the rain cover, refers to the orientation of the rain cover having the rain barrier material extended to cover at least a portion of the golf clubs.

Rain Proof as used herein is defined as a container that does not allow for direct access of rain into the interior; a container having an interior volume that is essentially fully enclosed.

Base mount as used herein is defined as a feature, such as extensions at the bottom of the multipurpose golf club container, that secures the container to a powered golf cart or provides support for holding the container upright, and may be adjustable in position or shape.

Shaft restraint as used herein is defined as a mechanism or geometric feature that holds the golf club or grip.

Club head restraint as used herein is defined as a mechanism or geometric feature that holds the golf club head.

Club restraint as used herein is defined as a mechanism or geometric feature that holds the golf club and may include but is not limited to a shaft restraint or club head restraint.

Laterally as used herein in reference to golf club removal from and placement into the multipurpose golf club container, means that the golf club can be removed from or placed into the container with a generally lateral motion wherein the club passes across the opening of the compartment approximately at one time and is not pull out of the opening of the compartment along the length of the club and therefore does not include lifting or pulling the golf club vertically out of the container as would be required with a convention golf bag.

Rigid as used herein in reference to the multipurpose golf club container or container compartments is defined as not easily deformed, and is self supporting.

Adjustable as used herein in reference to a base mount means that the base mount may be rotated, extended, expanded, or slid to provide a more stable base for support, to prevent the wheels from touching the ground, to provide for proper location and retention on a powered golf cart.

Head down position as used herein in reference to golf club storage configuration means that the golf club is retained in the multipurpose golf club container with the golf club head down or nearer to the bottom of the container, and the club grip up, or nearer to the top of the container during normal use.

While particular embodiments of the present invention have been illustrated and described herein, the present invention should not be limited to such illustrations and descriptions. It should be apparent that changes and modifications may be incorporated and embodied as part of the present invention within the scope of the following claims. It should be understood that certain features of the invention, which, for the sake of clarity are described in separate embodiments may be combined in various combinations into a single embodiment. Conversely, various embodiments or features which, for brevity, were described in the context of a single embodiment may also be provided separately or in any appropriate sub-combinations.

We claim:

1. A multipurpose golf club container comprising:

a. a first compartment comprising;

i. an inner surface and an exterior surface;

ii. an interior volume of space for receiving, containing, and retaining at least four golf clubs;

iii. a top that extends over the golf clubs, b. a second compartment comprising;

i. an inner surface and an exterior surface;

ii. an interior volume of space for receiving, containing and retaining at least four golf clubs;

iii. a top that extends over the golf clubs, c. a hinge connecting the first and second compartments;

d. golf club restraints configured in both the first and second compartment comprising shaft restraints;

e. a rain cover comprising a rain barrier material configured to be extended down from said top; and f. wheels;

whereby the multipurpose golf club container is configured such that a golf club can be inserted and removed from the shaft restraints within the interior volume of the first and second compartments laterally with the rain cover extended down in an engaged position, and therefore does not include lifting or pulling the golf club vertically out of the multipurpose golf club container, whereby the to of the first and second compartments protects the golf clubs from rain, and whereby the first and second compartments can be brought together to form an enclosure for retaining golf clubs.

2. The multipurpose golf club container of claim 1 wherein the golf club restraints are configured for retaining golf clubs in a head down position.

3. The multipurpose golf club container of claim 1 wherein the club restraint comprises club head restraints.

4. The multipurpose golf club container of claim 1 further comprising a restraint lock.

5. The multipurpose golf club container of claim 1 whereby the first and second compartments can be brought together to form a rain proof container for retaining golf clubs.

6. The multipurpose golf club container of claim 1 wherein the container is rigid.

7. The multipurpose golf club container of claim 1 wherein the container is a clamshell.

8. The multipurpose golf club container of claim 1 wherein at least three of the club head restraints are shaped to accept a specific club type.

9. The multipurpose golf club container of claim 1 wherein the rain cover comprises a rain barrier than can be extended over at least a portion of the interior surface of a compartment.

10. The multipurpose golf club container of claim 9, wherein the rain cover further comprises a retracting mechanism for retracting the rain barrier material.

11. The multipurpose golf club container of claim 9, wherein the rain cover barrier material is translucent.

12. The multipurpose golf club container of claim 1, wherein the rain cover is integral.

13. The multipurpose golf club container of claim 1 further comprising a retractable handle.

14. The multipurpose golf club container of claim 1 further comprising an interior storage feature.

15. The multipurpose golf club container of claim 1 further comprising a locking mechanism.

16. The multipurpose golf club container of claim 1 further comprising cart strap retaining features.

17. The multipurpose golf club container of claim 1 further comprising a base mount.

18. The multipurpose golf club container of claim 17 wherein the base mount is adjustable.

19. A multipurpose golf club container comprising a clamshell comprising:

a. a rigid first compartment comprising;

i. an inner surface and an exterior surface;

i. an interior volume of space for receiving, containing, and retaining at least four golf clubs;

ii. a top that extends over the golf clubs, b. a rigid second compartment comprising;

i. an inner surface and an exterior surface;

ii. an interior volume of space for receiving, containing and retaining at least four golf clubs;

ii. a top that extends over the golf clubs, c. a hinge connecting the first and second compartments;

d. golf club restraints configured in both the first and second compartment comprising shaft restraints;

e. a base mount;

f. an integral rain cover comprising:

i. a rain barrier material configured to be extended down from said top, ii. a retracting mechanism; and g. wheels;

whereby the multipurpose golf club container is configured for retaining a plurality of golf clubs in the compartments in a head down position, and whereby the multipurpose golf club container is configured such that a golf club can be inserted and removed from the first and second compartments laterally with the rain cover extended down in an engaged position, and therefore does not include lifting or pulling the golf club vertically out of the multipurpose golf club container, whereby said top of the first and second compartments protects the golf clubs from rain, and whereby the first and second compartments can be brought together to form a rain proof enclosure for retaining golf clubs.

* * * * *